US005806263A

United States Patent [19]

Coleman

[11] Patent Number: 5,806,263

[45] **Date of Patent: *Sep. 15, 1998**

[54] GLASS BLOCK CONNECTOR STRIP

[76] Inventor: William J. Coleman, 28 Henches Pl., Little Ferry, N.J. 07643

[ * ] Notice: This patent issued on a continued prosecution application filed under 37 CFR 1.53(d), and is subject to the twenty year patent term provisions of 35 U.S.C. 154(a)(2).

[21] Appl. No.: 597,391

[22] Filed: Feb. 8, 1996

[51] Int. Cl.[6] ..... E04B 1/12

[52] U.S. Cl. ..... 52/306; 52/308; 52/656.9; 40/547; 362/145; 362/147

[58] Field of Search ..... 52/306–308, 656.9, 52/747.1; 362/145, 147; 40/546, 547

[56] References Cited

U.S. PATENT DOCUMENTS

| | | | |
|---|---|---|---|
| 3,234,699 | 2/1966 | Smith | 52/173 |
| 3,429,602 | 2/1969 | Dirilgen | 287/189 |
| 3,925,950 | 12/1975 | von der Ley | 52/585 |
| 4,095,384 | 6/1978 | Zarriello | 52/408 |
| 4,612,746 | 9/1986 | Higgins | 52/220.5 |
| 4,625,266 | 11/1986 | Winter | 362/145 X |
| 4,891,925 | 1/1990 | Carlson et al. | 52/585 |
| 4,969,282 | 11/1990 | Eberhart | 52/306 X |
| 4,986,048 | 1/1991 | McMarlin | 52/306 |
| 5,006,967 | 4/1991 | Diamond | 52/306 X |
| 5,010,704 | 4/1991 | Thompson | 52/308 |
| 5,031,372 | 7/1991 | McCluer | 52/307 |
| 5,038,542 | 8/1991 | Kline | 52/306 |
| 5,277,005 | 1/1994 | Hellwig et al. | 52/220.7 X |
| 5,337,225 | 8/1994 | Brookman | 362/147 X |
| 5,341,615 | 8/1994 | Hodges et al. | 52/220.7 |
| 5,430,985 | 7/1995 | Coleman | 52/308 |
| 5,485,702 | 1/1996 | Sholton | 52/308 |
| 5,572,818 | 11/1996 | Churchill | 40/547 |
| 5,575,553 | 11/1996 | Tipton | 40/546 X |
| 5,625,968 | 5/1997 | Ashall | 40/546 |
| 5,678,334 | 10/1997 | Schoniger | 40/546 |

*Primary Examiner*—Lanna Mai
*Attorney, Agent, or Firm*—Friscia & Nussbaum

[57] ABSTRACT

A connector strip is disclosed for assembling a building wall of glass blocks. The strip includes a longitudinal center section having a pair of oppositely disposed and longitudinally extending grooves dimensioned to receive a centrally located ridge extending peripherally around the outer edge surfaces of a molded building block to which the strip is to be mounted. U-shaped channels extend along the center groove for receiving wiring such as fiber optics for illuminating the glass block wall. Peripheral members and secondary walls serve to strengthen the connector strip, engage marginal edge surfaces of glass blocks and facilitate cement bonding between the connector strip and the adjacent blocks. A fastener member also is provided for coupling together adjacently positioned connector strips to form a rigid framework for assembling successive rows of blocks into a wall assembly.

7 Claims, 4 Drawing Sheets

GLASS BLOCK CONNECTOR STRIP

BACKGROUND OF THE INVENTION

1. Field of the Invention

This invention generally relates to a connector strip for a glass block wall assembly, and more specifically to a connector strip for allowing wiring to pass through a glass block wall, which wiring may be used to illuminate the glass block wall.

2. Related Art

Glass blocks have in the recent past gained much popularity with architects, builders and homeowners. In addition to being aesthetically pleasing, glass blocks are extremely functional in providing privacy to a room without loss of natural sunlight. On exterior applications, glass blocks help to insulate, thereby allowing HVAC systems to operate more efficiently. However, because of the high cost and difficulty associated with the installation thereof, use of glass blocks in the past has been limited.

Heretofore, it has been known to assemble a glass block wall utilizing a spacer strip positioned between the edge surfaces of adjacently positioned blocks and between the opposite or flat faces of successive rows of such blocks to form the wall. An example of such a spacer fabricating device is disclosed in U.S. Pat. No. 4,095,384 dated Jun. 20, 1978 to Zarriello, which discloses an elongated corrugated cardboard strip having upper and lower surfaces thereof coated with a tar composition. The strips are positioned between tiers of building blocks and between the edge surfaces of adjoining blocks. The strips are mounted to the respective blocks by means of engagement of the tar surfaces of the strips to the adjacent surfaces of the blocks. Specifically, by pressing the blocks into the tar composition on the surfaces of the associated strips, it is possible to align the adjacently positioned blocks and the successive rows or tiers of such blocks to form a wall assembly.

The strips have a width less than the width of the building blocks to which said strips are respectively mounted to form a groove or channel between the outer edges of adjacently located blocks. A mortar composition is then filled within such groove to anchor the blocks and connector strips in place. However, Zarriello makes no provision for accommodating wiring passing through the glass block wall to illuminate the glass block wall.

Another spacer device is disclosed in U.S. Pat. No. 5,430,985 dated Jul. 11, 1995 to Coleman, the same inventor as that of the present invention. The entire disclosure of Coleman is expressly incorporated herein by reference. The connector disclosed in Coleman provides an improved, simple and efficient spacer for constructing glass block walls. However, Coleman makes no provision for accommodating wiring passing through the glass block wall to illuminate the glass block wall. Accordingly, if one wanted to utilize fiber optics positioned between the glass blocks forming the wall to illuminate the glass blocks to create a pleasing illuminated effect, one could not do so according to the teachings of Coleman.

Likewise, other efforts in the past, do not teach or suggest a connector strip having means for accommodating wiring therein to allow such wiring to pass through a glass block wall. These previous efforts include U.S. Pat. No. 3,234,699 dated February, 1966, to Smith, U.S. Pat. No. 3,429,602 dated February, 1969, to Dirilgen, U.S. Pat. No. 3,925,950 dated December, 1975, to von der Ley, U.S. Pat. No. 4,891,925 dated January, 1990 to Carlson, et al., U.S. Pat. No. 4,986,048 dated January, 1991, to McMarlin, U.S. Pat. No. 5,010,704 dated April 1, 1991, to Thompson, and U.S. Pat. No. 5,031,372 dated July 1991 to McCluer. None of these previous efforts teach or suggest a connector strip having means for accommodating wiring therein to allow such wiring to pass through a glass block wall.

Accordingly, in the past, if it were desired to pass wiring through or along a wall made of such glass blocks, one had to run such wiring through a tube or other means located within mortar positioned between blocks forming the wall. Such a method for running wiring through glass block walls was expensive, inconvenient, cumbersome and accordingly prohibited a do-it-yourselfer from running wiring through a glass block wall.

It has become apparent that a different type of connector strip is needed for assembling a glass block wall that can accommodate wiring therein. Further, a fastener element also is needed to couple together adjacent segments of adjacently positioned connector strips to form a substantially rigid framework for each block which enables rows or tiers of such glass blocks to be easily and accurately aligned in place, and be firmly anchored to one another, while still accommodating wiring running therebetween.

None of the previous efforts, teach or suggest the benefits and advantages of the present invention, nor do such previous efforts show or describe the structural configuration of the present invention. A summary of the features applicable to the improved and novel connector strip is hereinafter set forth.

OBJECTS AND SUMMARY OF THE INVENTION

It is a primary object of the present invention to provide a connector for a glass block wall which connector can accommodate wiring extending therealong.

It is another object of the present invention to provide a connector for a glass block wall which connector can accommodate fiber optics therealong for the purpose of illuminating the glass block wall.

It is another object of the present invention to provide a connector for a glass block wall which connector can accommodate wiring and which connector is sturdy to support glass blocks forming a wall.

It is another object of the present invention to provide a connector for a glass block wall which connector can be used horizontally and vertically to support glass blocks forming a wall.

It is another object of the present invention to provide a connector for a glass block wall which connector includes a clip for interconnecting vertical extending pieces of the connector with horizontal extending pieces of the connector.

It is another object of the present invention to provide a connector for a glass block wall which connector can be used for a glass block wall with or without wiring.

It is another object of the present invention to provide a connector for a glass block wall which connector can be utilized without wiring, but which connector can subsequently accept wiring after the wall is completed.

It is another object of the present invention to provide a connector for a glass block wall which connector can be used to retrofit the glass block wall with wiring.

It is another object of the present invention to provide a connector for a glass block wall which connector is simple and easy to use.

It is another object of the present invention to provide a connector for a glass block wall which connector is relatively inexpensive.

It is another object of the present invention to provide a connector for a glass block wall which connector is economical to manufacture.

It is another object of the present invention to provide a connector for a glass block wall which connector enables a do-it-yourselfer to construct an illuminated glass block wall.

It is another object of the present invention to provide a connector for a glass block wall which connector provides proper spacing and alignment between glass blocks forming a glass block wall.

It is another object of the present invention to provide a connector for a glass block wall which connector allows for a glass block wall to be constructed of different sized glass blocks.

It is another object of the present invention to provide a connector for a glass block wall which connector reduces installation time over conventional methods of installing illuminated glass block walls.

The present invention provides for a rigid longitudinal connector strip formed having a longitudinally extending center section. The center section has parallel channels with a longitudinally extending groove positioned centrally therebetween. The groove is dimensioned to receive therein a portion of a centrally located ridge extending peripherally about outer edge surfaces of a glass building block to which said strip is to be mounted.

The channels positioned along the groove of the center section include inner sides, outer sides and base sides extending therebetween to form two U-shaped channels extending longitudinally the length of the connector strip. A central member extends between opposing inner surfaces of the channels to form upper and lower grooves. Accordingly, the groove of the connector strip serves to locate the strip on a glass block and to locate another glass block in alignment with the first block. The channels are sized to receive wiring, such as fiber optics, and to allow for such wiring to extend along the length of the connector strip (i.e. the length of the glass block wall).

Interconnected with the outer sides of the channels are a pair of oppositely disposed and longitudinally extending peripheral members projecting outwardly from the channels. The peripheral members are centrally located along the width of the outer sides, the peripheral members each being aligned in the same plane and extending for the length of the strip. The connector strip may further include one or more secondary walls interconnected with the peripheral members at right angles therewith and spaced away from the channels for the purposes of assisting with the alignment and spacing between blocks and/or facilitating the adherence between adjacent blocks and a cement composition used to set the blocks.

The overall width of the connector strip is preferably less than the width of the building block to which the strip is to be mounted to locate the longitudinal edges of the flanges in contact with marginal edge surfaces of the building block. Also, each of the flanges also may have a plurality of oppositely disposed and laterally extending ribs projecting outwardly from the peripheral members and/or any secondary walls on opposite sides of the channels for engaging marginal edge surfaces of the building block to which the strip is to be mounted and for facilitating cement bonds between the connector strip and the adjacent blocks. The oppositely disposed and laterally extending ribs may be arranged in pairs aligned in the same plane, with said ribs projecting outwardly of the respective walls to the longitudinal edges of the strip. Silicon may be used as a cement or bonding agent between the strip and the glass blocks. Alternatively, resiliently compressible material also may be mounted to the opposing surfaces of the channels on either side of the longitudinally extending grooves. The compressible material serves to compensate for irregularities in the outer edge surfaces of the glass blocks. The compressible material has an outer surface coated with a pressure sensitive adhesive, and is provided with a removable release sheet adapted to be removed from the adhesively coated surface when the strip is mounted to the block.

The overall arrangement described above provides for a connector for glass blocks with longitudinal channels defining parallel open compartments on opposite sides of central grooves. The grooves locate the connector strip with respect to adjacent glass blocks and the channels permit wiring such as fiber optics to extend along the connector strip and hence through the glass block wall. The invention further provides for a fastener or clip for coupling together adjacent segments of adjacently positioned connector strips to form a substantially rigid framework to erect a wall of such glass blocks. The fastener is useful for fastening together longitudinal lengths of the connector as well as for interconnecting connector strips at right angles with respect to each other.

There is, thus, provided a novel connector strip for assembling a building wall of glass blocks which is relatively simple in nature, and which can be used by a person with little or no special training in the art of assembling building block wall assemblies.

BRIEF DESCRIPTION OF THE DRAWINGS

Other important objects and features of the invention will be apparent from the following Detailed Description of the Invention taken in connection with the accompanying drawings in which.

DETAILED DESCRIPTION OF THE INVENTION

Figure 1:
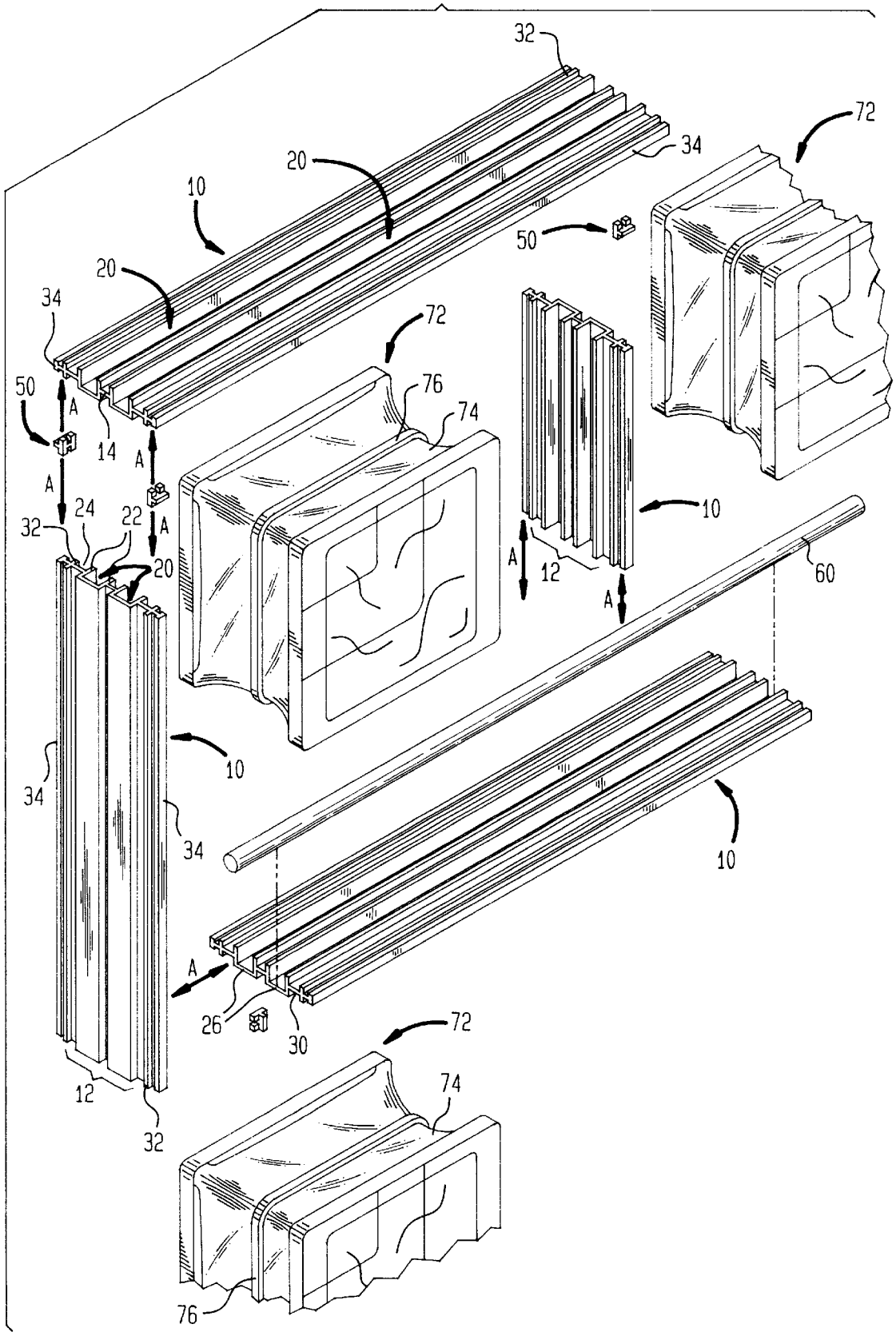
FIG. 1 is a partially exploded perspective view of a glass block wall assembly utilizing the connector strips of the present invention.

Referring to the drawings, particularly FIGS. 1–4, numeral 10 represents a longitudnal connector strip constructed in accordance with the present invention. Except as noted hereinafter, strip 10 is substantially rigid and may be molded of polyethylene or polypropylene material, or any other suitable material. Strip 10 is formed having a longitudinally extending center section 12 having a center member 14. Positioned alongside the center member 14 are channel members 20 each comprising inner side wall 22 and outer side walls 24 with base walls 26 joining the inner and outer side walls 22 and 24 at lower ends thereof to form a U-shaped interior area 28 within each channel member 20.

The channels 20 are sized and configured to accept wiring therein. Accordingly, an electrical wire may extend along the channels in strip 10. As such, wiring can be run through and/or along a glass block wall constructed with the connector strip of the present invention. Further, the channels are sized and configured to accept fiber optics such as a solid core or a fiber stem. Accordingly, the fiber optics can be run along the channels such that when illuminated, the glass block wall is illuminated. This effect can be achieved because the open side of the channel faces directly at a side wall of a glass block forming a glass block wall. Importantly, a fiber optic cable can be run along the strip 10 at each layer of the wall to provide a even, crisp illumination to the wall. Additionally, it should be pointed out that the connector strip of the present invention could also be used without a fiber optic cable to put up a non-illuminated wall. However, if at some later time, one desired to light up the glass block wall, one could drill through the end of the wall at a position corresponding to a channel formed in the strip and snake a fiber optic cable through the strip along the channel. Additionally, it should be pointed out that the configuration of the channel or channels can be varied to different cross sectional shapes as long as the channel can carry a wire. Also, it should be noted that the U-shaped channels could face the same direction or at opposite directions. Further, the present invention could be practiced by means of a connector strip having only one channel therein.

The center member 14 extends between and interconnects the inner side walls 22 at a central location thereof to form upper and lower grooves 16 and 18 respectively between channels 20. The upper and lower grooves 16 and 18 are centrally located on the strip 10 and are sized and configured to receive therein a portion of a centrally located ridge extending peripherally around the outer edge surfaces of a molded building block to which strip 10 is to be mounted as hereinafter described.

A structural rod or other member could be inserted into a channel in the strip to provide increased structuarl support to a wall of blocks.

Extending from the outer walls 24 of the channels 20 at central locations are peripheral members 30 aligned in the same plane as each other and in the same plane as the center member 14 and extend the length of the strip 10. One or more secondary walls 32 can be perpendicularly interconnected with the peripheral members 30. Such secondary walls 32 would be spaced away from the channels 20 and serve to provide assistance with alignment and spacing between blocks, as well as facilitating adherence between the strip 10, the glass blocks and a cement composition employed to cement the assembly together. Additionally, end walls 34 may also be perpendicularly interconnected with the peripheral members 30. The end walls 34 would be spaced apart from the secondary walls 32, and would serve to provide further assistance with alignment and spacing between blocks, as well as to facilitate adherence between the strip 10, the glass blocks and a cement composition employed to cement the assembly together.

As will become hereinafter apparent, the width of strip 10 is less than the width of the building block to which said strip is to be mounted to locate the end walls 34 in contact with marginal edge surfaces of the building block.

It is may be desirable for the peripheral members 30 to include a plurality of oppositely disposed and laterally extending ribs (not shown) projecting outwardly therefrom on opposite sides thereof. Such oppositely disposed and laterally extending ribs would be arranged in pairs aligned in the same plane, with the plurality of pairs of such ribs spaced apart from one another over the length of strip 10. The ribs would project outwardly of peripheral members 30, extending to the end walls 34. In the configuration thus described, the secondary walls 32 and the end walls 34 and the ribs would define a plurality of open compartments on the upper and lower sides of the peripheral members 30 at the outer edges thereof.

It may be desirable to apply to the upper and lower surfaces of the center section 12 a resiliently compressible material (not shown) made of foam or rubber or the like. Such a compressible material would extend for the length of strip 10 and could be positioned in overlying relation to the U-shaped interior area 28 of the channels 20. The compressible material could be coated with a pressure sensitive adhesive having a release sheet mounted over the adhesive and adapted to be removed therefrom when strip 10 is mounted to a building block. The compressible material would be used to take into account irregularities in the surfaces of the block as hereinafter described.

Figure 5:
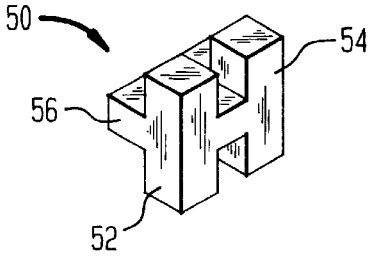
FIG. 5 is a perspective view of a clip for use in connection with the connector strip of the present invention.

Referring to FIGS. 1 and 5, there is shown a fastener member or clip represented generally by the numeral 50 for coupling together adjacent segments of adjacently positioned connector strips 10. Clip 50 may be made of any suitable material such as substantially rigid plastic, as is strip 10, and is formed having a first post element 52 and a second post element 54, spaced apart from one another by an interconnecting block member 56. The block member 56 serves to space apart posts 52 and 54 by a distance substantially equal to the thickness of the peripheral members 30 and also substantially equal to the thickness of the secondary walls 32. Accordingly, the posts 52 and 54 can be slidably engaged with peripheral members 30 or the secondary walls 32 at one side of the block member 56, and the posts can likewise be slidable engaged with peripheral members 30 or the secondary walls 32 at the other side of the block member 56 such that the clip 50 engages two separate strips 10 to join such strips 10 together either at a right angle or longitudinally. Importantly, block member 56 serves to space apart adjoining strips 10. Preferably, clips 50 are used in pairs to adjoin together at outer edges thereof.

Referring to FIG. 1, the glass block is represented by numeral 72 having outer edge surfaces 74. A centrally located ridge 76 extends peripherally around the outer edge surfaces of the block. If strips 10 are regarded as being disposed in horizontal and vertical positions, the elongated horizontal strips 10 may be formed in 3 or 4 foot (91.44 cm) lengths, or any other length, so as to span or cover a plurality of adjacently positioned blocks 72. Where necessary, a plurality of such horizontally disposed strips 10 may be coupled together in edge-to-edge relation by fastener member 50.

The invention further provides for a vertically orientated connector strip 10 to be disposed between adjacent blocks 72. These so-called vertical strips are of a length slightly less than the height of the block. Here, again, the same kind of fastener member 50 is used to couple a vertically oriented strip to a horizontally oriented strip. The end result is to form a substantially rigid framework around each block with the horizontally and vertically oriented connector strips coupled together by the fastener members. This framework is joined together as shown in FIG. 1 by arrows A.

When mounting the connector strips 10 to the respective blocks 72, it will be appreciated that, if a compressible material with a release sheet is employed, the release sheet is first removed from the adhesive surface of the compressible material. If silicon is used, it is applied to the strip or to a block and the strip is then positioned on a block. The strip is then positioned on the edge surface 74 of block 77 with the block ridge 76 received in the central groove 16 or 18, as the case may be, of strip center section 12. This serves to locate the compressible material, which may be positioned on either side of the center section, in engagement with the outer edge surfaces of the block on either side of the block ridge. The strip may be firmly mounted to the block without undue play by reason of the compressible material which takes into account any irregularities or unevenness in the edge surfaces of the block.

Figure 2:
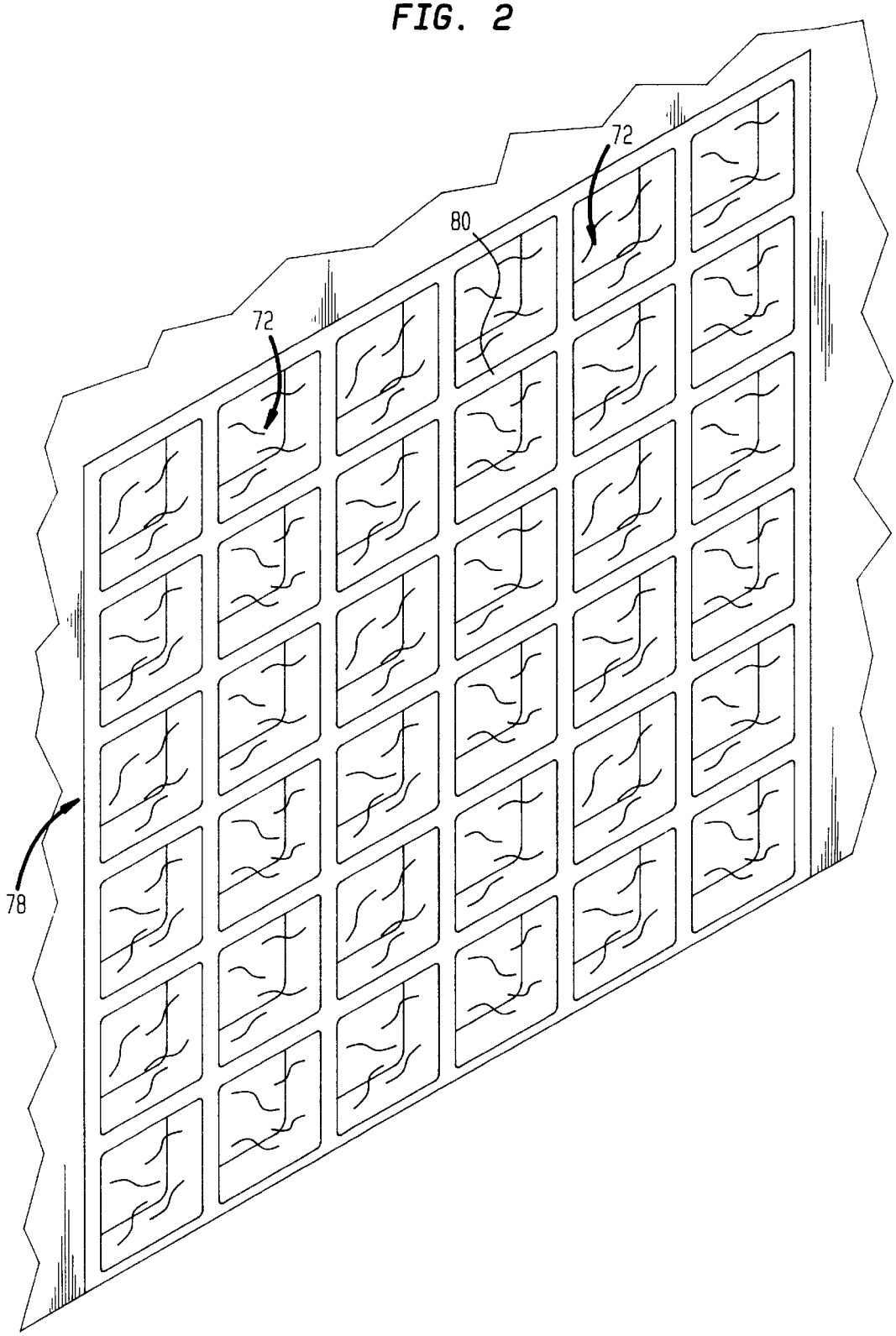
FIG. 2 is a perspective view of a block wall assembled from the components illustrated in FIG. 1.
Figure 3:
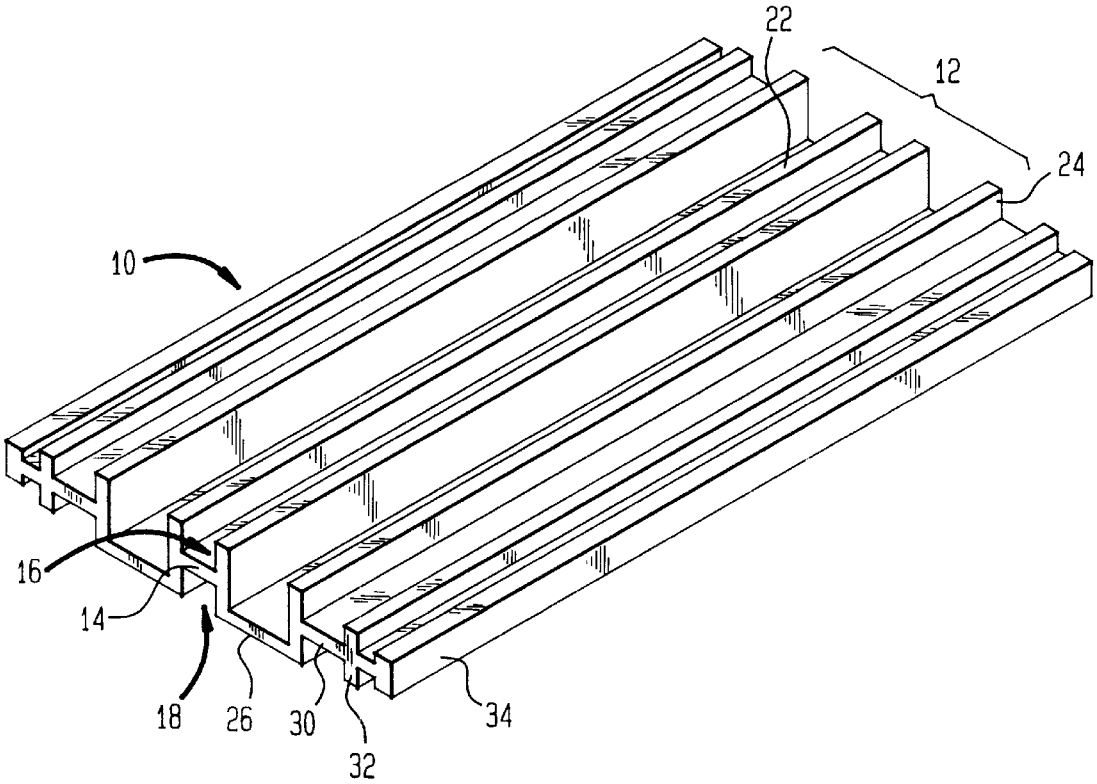
FIG. 3 is a partial perspective view of the connector strip constructed in accordance with the present invention.
Figure 4:
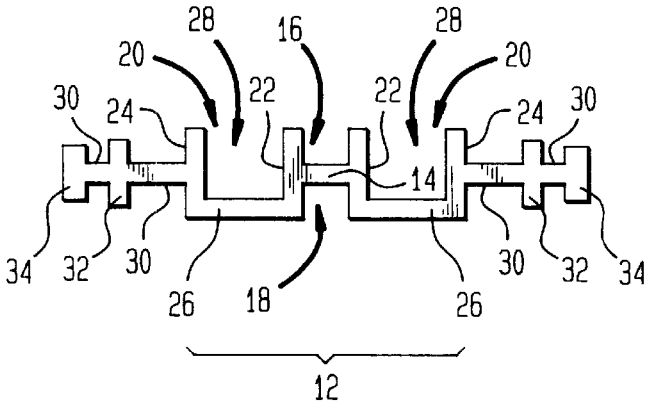
FIG. 4 is a cross sectional view of the connector strip taken along line 4—4 of FIG. 3.

FIG. 2 illustrates a building wall represented generally by numeral 78 assembled from the components of FIG. 1. In assembling building wall 78 it may be assumed that an opening has been formed in the structure which is to contain the rows or tiers of glass blocks 72. The size of the opening can be predetermined from the dimensions of the blocks. Also, once the height of the block is known, the so-called vertical strips that makeup the framework between adjacent blocks can be cut to be of a length slightly less than the block height. The width of the strip is selected to be less than the width of the block thereby to locate the end walls in contact with marginal edge surfaces of the block. The arrangement is such that the secondary walls, end walls and lateral ribs, if any, define a plurality of open compartments on opposite sides of the peripheral members of the strip.

Figure 6:
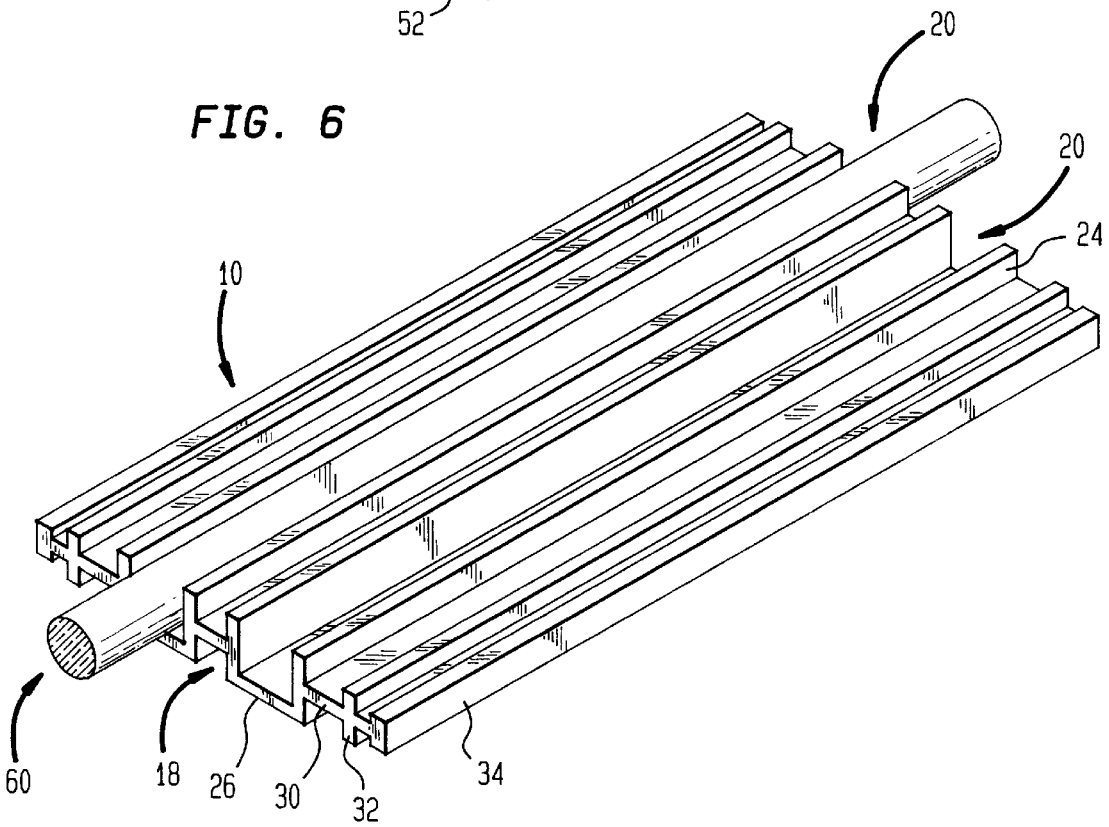
FIG. 6 is perspective view of the connector strip shown in FIG. 3 showing a wire positioned within a channel of the connector strip.

Referring now to FIG. 6, a fiber optic or other cable or wiring 60 is shown positioned within a channel 20 of the connector strip 10. From reference to this FIG. it is noticed that another cable could be positioned within the other parallel channel, or that alternatively, a second wire or cable having properties different than the first could be positioned within the other channel. Additionally, it should be pointed out that an additional side, i.e. a top (not shown) could be positioned over the other channel to thereby enclose same. Further, it may be desirable to orient the other channel to face in the opposite direction of the first channel. Finally, it may also be desirable and is considered within the scope of this invention to fill in the second channel such that it is a solid member.

Figure 7:
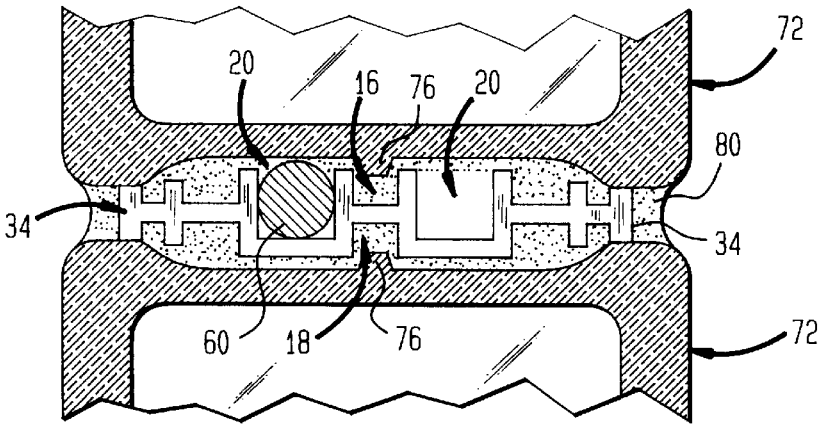
FIG. 7 is a cross sectional view of the connector strip shown in FIG. 5 positioned between glass blocks.

Referring now to FIG. 7, a connector strip of the present invention is shown positioned between glass blocks 72, the ridges 76 thereof extending into upper and lower grooves 16 and 18 of the connector strip. A wire or cable of fiber optics or other is positioned within a channel 20 of the strip. The strip is secured between blocks by means of a cement composition such as silicon 80. The cement composition may or may not be applied to the outer edges of the end walls.

It is preferred that the connector strips be used to form the perimeter of the wall opening on all four sides. The first row of blocks is then mounted to the strips which form the floor as base of the opening. Alternatively, the size of the opening could be selected so that the outer edge surfaces of blocks form the perimeter for the opening. However, the use of connector strips to form the perimeter of opening will result in a more sturdy framework.

As previously noted, vertical connector strips are positioned between the adjacent blocks in a row. After the first row of blocks is in place, horizontal connector strips are placed on top of the row. Fastener members are employed to couple the vertical strips sandwiched between a row of blocks to the horizontal strips positioned above and below said row. The procedure is then repeated for assembling successive rows of blocks.

The uppermost row of blocks may be positioned in place by using a flat edge tool to displace the blocks slightly downwardly from the row of connector strips which defines the upper framework for the opening. There is still sufficient play, at this point in the wall assembly, to position the top row of blocks in place.

With the wall thus assembled, the blocks will have an outer peripheral edge laterally spaced from the longitudinally extending edges of the associated connector strips mounted thereon. The spacing between the outer edges, respectively, of adjacently located blocks and the adjacent longitudinally extending walls of the associated strips defines a plurality of channels which encompass the compartments formed. A binder composition, such as mortar 80, may be applied within the channel to anchor the blocks and associated connector strips in place wherein the compartments define multiple surfaces for receiving the binder composition.

There is thus provided a novel connector strip which in combination with an interlocking fastener member provides a framework for firmly and securely assembling a glass block building wall in which the blocks and the associated connector strips are anchored in place with a binder composition. The connector strips of the present invention could be injection molded. However, it may be more economical for such strips to be extruded.

While a preferred embodiment of the invention has been shown and described in detail, it will be readily understood and appreciated that numerous omissions, changes and additions may be made without departing from the spirit and scope of the invention. Having thus described the invention in detail, it is to be understood that the foregoing description is not intended to limit the spirit and scope thereof.

What is desired to be protected by Letters Patent is set forth in the appended claims.

What is claimed is:

1. An illuminated glass block wall comprising:

a plurality of glass blocks arranged end to end to form row of glass blocks having a top edge;

a rigid connector positioned to extend along the top edge of the row of glass blocks;

a plurality of glass blocks positioned end to end on the rigid connector to form a second row of glass blocks to form a glass block wall;

the rigid connector comprising:

a rigid center member having two ends;

rigid inner upright walls perpendicularly interconnected with the center member at the ends of the center member to define upper and lower grooves between the inner upright walls and the center member;

rigid base walls perpendicularly interconnected with the center member at upper ends of the inner walls, the base walls extending outward from the inner upright walls and away from the center member;

rigid outer upright walls perpendicularly interconnected with the base walls at far ends of the base walls away from the inner upright walls, the outer upright walls extending parallel to the inner upright walls, the outer upright walls facing the inner upright walls to form U-shaped rigid channels, the channels receiving illumination means therein;

peripheral members extending perpendicularly from a center area of the outer upright walls away from the channels, the peripheral members aligned in the same plane as the center member;

the illumination means positioned within a channel of the rigid connector and extending along the length of the channel, the illumination means shining light from the channel means to within the glass blocks to illuminate the glass block wall.

2. The illuminated glass block wall of claim 1 further comprising rigid end walls perpendicularly interconnected with far ends of the peripheral members away from the channels, the end walls interconnected with the peripheral members at locations central of the end walls, the end walls including upper and lower faces for contacting and supporting adjacent glass blocks.

3. The illuminated glass block wall of claim 2 further comprising secondary walls perpendicularly interconnected with the peripheral members between the channels and the end walls, the secondary walls interconnected with the peripheral members at locations central of the secondary walls.

4. The illuminated glass block wall of claim 3 further comprising a plurality of ribs extending laterally between upper ends of the secondary walls and upper ends of the end walls.

5. The illuminated glass block wall of claim 4 further comprising a plurality of ribs extending laterally between lower ends of the secondary walls and lower ends of the end walls.

6. The illuminated glass block wall of claim 3 further comprising illumination means extending within at least one of the channels, the illumination means extending along the length of the at least one of the channels.

7. The illuminated glass block wall of claim 6 wherein the illumination means comprises fiber optics extending within and along the length of the at least one of the channels.

* * * * *